US005524173A

United States Patent [19]

Puckette

[11] Patent Number: 5,524,173

[45] Date of Patent: Jun. 4, 1996

[54] PROCESS AND DEVICE FOR MUSICAL AND VOCAL DYNAMIC SOUND SYNTHESIS BY NON-LINEAR DISTORTION AND AMPLITUDE MODULATION

[75] Inventor: Miller Puckette, Cormeilles en Parisis, France

[73] Assignee: France Telecom, Paris, France

[21] Appl. No.: 399,982

[22] Filed: Mar. 7, 1995

[30] Foreign Application Priority Data

Mar. 8, 1994 [FR] France ..... 94 02655

[51] Int. Cl.[6] ..... G10L 7/02

[52] U.S. Cl. ..... 395/2.77

[58] Field of Search ..... 395/2.73, 2.77, 395/2.69, 2.67; 381/51, 53, 52

[56] References Cited

U.S. PATENT DOCUMENTS

| | | | |
|---|---|---|---|
| 3,826,859 | 7/1974 | Suzuki | 84/1.17 |
| 4,351,218 | 9/1982 | Deutsch | 84/1.19 |
| 4,406,204 | 9/1983 | Katoh | 84/1.19 |
| 4,422,362 | 12/1983 | Chibana | 84/1.19 |
| 5,391,827 | 2/1995 | Koyama | 84/600 |

OTHER PUBLICATIONS

Signal Processing VI; Proceedings Of The Eusipco 92, vol. 1, 24 Août 1992, Brussels, BE, pp. 347–350; Richard et al. 'Unvoiced Speech Analysis and synthesis using Poissonian Random Formant–Wave–Functions' *p. 348, alinéa 3.2*.

Journal Of The Audio Engineering Society, vol.36, No.9, Sep. 1988, New York, US pp. 671–685; Palamin et al. 'A method of generating and controlling musical asymmetrical spectra'.

ICMC Glasgow 1990 Proceedings; Explode: A user interface for sequencing and score following; pp. 259–261; Puckette, Miller.

Computer Music Journal, vol.17, No.4, 1993, MA, US, pp. 17–29 Horner et al. 'Genetic Algorithms and their Application to FM Matching Synthesis' p. 18, line 18, p. 20, line 38.

Patent Abstracts Of Japan, vol. 17, No. 105 (p1495) Mar. 3, 1993 & JP–A–04 294 400 (Yamaha) Oct. 19, 1992.

Journal Of The Audio Engineering Society; The Synthesis of Complex Audio Spectra by Means of Frequency Modulation; Chowning, John M. pp. 526–534.

Computer Music; Subtractive Synthesis; Dodge, Charles pp. 155–193.

Interface, vol. 6, 1977, pp. 81–96, The VOSIM Signal Spectrum Tempelaars, S.

Computer Music Journal; The CHANT Project: From the Synthesis of the Singing Voice to Synthesis in General; pp. 15–31 Rodet, Xavier; Potard, Yves; Barriere, Jean–Baptiste.

Journal Of The Audio Engineering Society, Apr. 1979, vol. 27, No. 4 Digital Waveshaping Synthesis; Le Brun, Mark; pp. 250–266.

*Primary Examiner*—Allen R. MacDonald
*Assistant Examiner*—Carlos Villamar
*Attorney, Agent, or Firm*—Larson & Taylor

[57] ABSTRACT

A process and a device for the musical and vocal dynamic sound synthesis of formants associated with a fundamental sound. To produce a formant, a wave form is generated with is the sum of several sound components of the form $$X(t) = \sum_{k=-\infty}^{\infty} [\mathrm{Cos}(k\omega_o + \omega_s)t + i\sin(k\omega_o + \omega_s)t]e^{-\frac{|k\omega_o+\omega_s-\omega_c|}{\delta}}$$

wherein $\omega_0$ denotes the angular frequency of the fundamental sound, $\omega_s$ denotes a shift of angular frequency of the formant with respect to the fundamental sound, $\omega_c$ denotes the central angular frequency of this formant, and $\delta$ denotes the bandwidth of the latter. The amplitude of each component is of the form:

$$A = e^{-\frac{|k\omega_o+\omega_s-\omega_c|}{\delta}}.$$

The frequency or angular frequency parameters are modulated temporally in order to carry out the dynamic sound synthesis, the phase relations between formants thus being preserved.

8 Claims, 4 Drawing Sheets

PROCESS AND DEVICE FOR MUSICAL AND VOCAL DYNAMIC SOUND SYNTHESIS BY NON-LINEAR DISTORTION AND AMPLITUDE MODULATION

The present invention relates to a process and device for musical and vocal dynamic sound synthesis by non-linear distortion and amplitude modulation of a fundamental sound.

The creation by sound synthesis of an instrumental or voiced sound usually involves a consideration of the changes in the sound components as a function of the frequency and of the amplitude of a note or of a group of notes for their duration of perception.

For most natural sounds, their timbre is best described and analyzed by their spectral envelope, this providing a specification of the temporal change in the sound spectrum which is independent of the pitch of the sound. Thus, a voiced sound, spoken or sung, is usually defined by a fundamental sound and several formants or sound amplitude peaks in its spectral envelope. The contribution of a formant to the timbre of the sounds perceived is substantially determined by its amplitude, its central frequency and its bandwidth. It is therefore possible to reconstruct, by approximation, a given spectral envelope by determining its highest amplitude peaks and to represent them as formants which can then be synthesized.

In most sounds, voiced or unvoiced, the spectral envelope changes dynamically over time, and for the purpose of synthesizing such sounds, obviously of interest, the creation of a sound endowed with a static spectral envelope is not sufficient. It is necessary, for this purpose, to be able to modify the spectral envelope of the synthesized sounds continuously over time.

Figure 1:
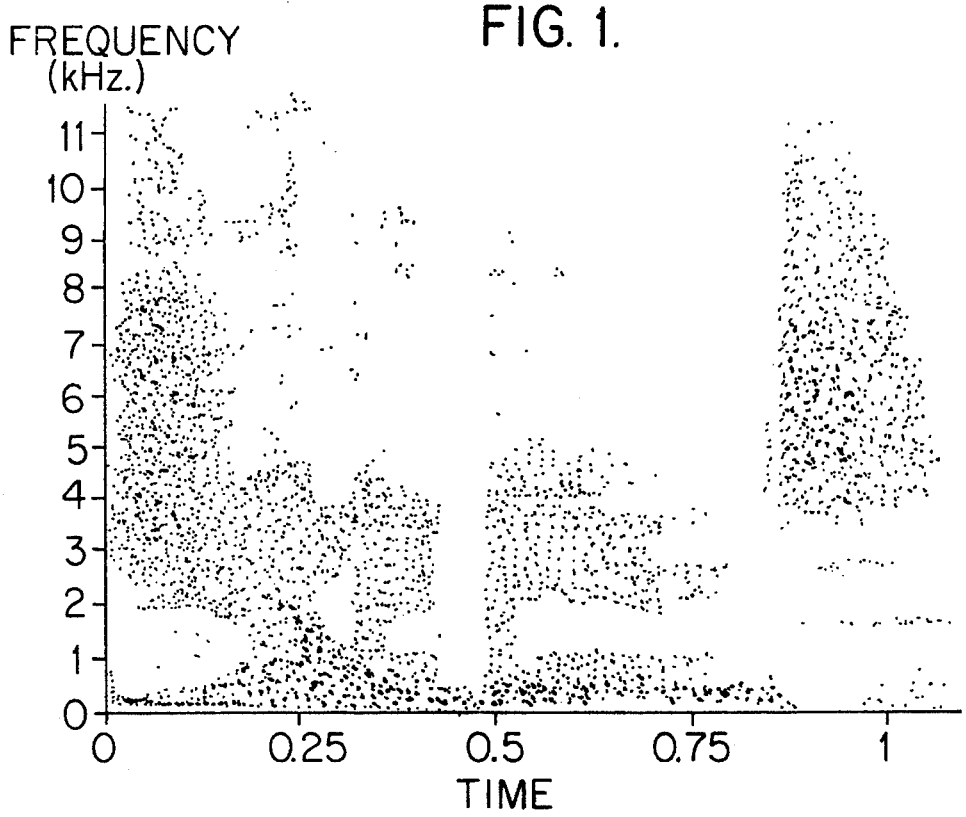

FIG. 1 shows a frequency analysis of a spoken word. The corresponding sound emitted can be analyzed and described by its formants, represented by the dark areas of greater amplitude in the spectrum, changing amplitude and frequency over time. Moreover, although not visible when observing FIG. 1, some of these formants are not voiced and faithful synthesis must take account of such a distinction.

Various attempts have been made hitherto to synthesize voiced sounds or the like from an analysis of their temporal change. None of the corresponding solutions proposed can readily be used in real time in the music sector. In all cases, either the data representative of the sounds has to be preprocessed appropriately, requiring for this purpose a very large amount of calculation, and real-time synthesis from input data cannot be performed, or, based on a lesser volume of calculations, the quality of the synthesized sound is not sufficient for application to the music sector.

Among the known methods used to produce complex spectra, a method of additive or subtractive synthesis has been described in the article entitled "*Subtractive Synthesis*" published by DODGE, C. and JERSE T. Computer Music, pp. 155–194, Shirmer New-York 1985. In additive synthesis, a sinusoidal oscillator is used for each sound component, this enabling the amplitude and the frequency of each component to be controlled independently. This method has the major drawback of requiring a large number of oscillators, as many as one hundred for a single sound, this very quickly limiting the possibilities of controlling all the components in the music sector in particular. In subtractive synthesis, a wideband sound signal is filtered by means of a simple bandpass filter. This less complex method nevertheless has the following drawbacks: phase shifting of the sound components, except when using very expensive linear phase-shift filters, difficulty in predicting the output amplitude of the sound components delivered by the filter, not only under transient conditions but also under steady conditions, and the major difficulty of the numerical accuracy of the amplitude of the sound components, on output in particular, in the case when recursive filters are used.

Another technique of sound synthesis, which is less complex, less expensive and has acceptable numerical accuracy, consists in performing a frequency modulation in order to produce dynamically variable complex sound spectra. See the article entitled "*The synthesis of complex audio spectra by means of frequency modulation*" published by J. CHOWNING, Journal of the Audio Engineering Society, 21/7, pp. 526–534, 1973. In this method, for a modulation of the type $$X(t)=\sin\,[\omega_c t+x\,\sin(\omega_m t)]$$

starting from a carrier wave angular frequency $\omega_c$, from a modulation angular frequency $\omega_m$ and from a modulation index x, the frequency spectrum is given by the relation $$X(t)=\sum_{k=-\infty}^{\infty} Jlkl(x)\sin[(\omega_c+k\omega_m)t]$$

For each value of k there exists a sound component of frequency $\omega_c+k\omega_m$ and amplitude Jlkl(x) where Jlkl(x) denotes the value of the corresponding Bessel function. The amplitude of the various components varies with the modulation index. Such a variation does not however make it possible to obtain ideally diversified sound frequency spectra by virtue of the monotonic time dependence of the phase term. Attempts to generalize the modulation on the basis of lookup tables have moreover been proposed. However, the complexity of the spectra obtained has not permitted a corresponding effective real-time use in the music sector.

Two other methods of synthesis have been proposed in which a direct definition of the central frequency and of the bandwidth of the formants is provided for. These methods, described in the publication entitled "*THE VOSIM signal spectrum*", INTERFACE Journal 6, pp. 81–96, 1977 by S. TEMPLAARS respectively in the publication "*The CHANT project: from the synthesis of the singing voice to the synthesis in general*" by X. RODED, Y. POTARD and J. B. BARRIERE, 1984, COMPUTER MUSIC JOURNAL 8/3, pp. 15–31. The last two methods mentioned make it possible to obtain sound component outputs whose spectrum is more complex than those obtained by subtractive synthesis and whose phases are more difficult to predict and to control. Furthermore, the last method mentioned raises the additional problem of the variability of the number of calculation operations independently of the synthesis parameters, this making it difficult to adapt it to real-time synthesis.

The object of the present invention is to remedy the drawbacks of the aforesaid prior art methods by implementation of a process of musical and vocal dynamic sound synthesis by non-linear distortion and amplitude modulation making it possible, by maintaining specified phase relations between synthesized formants, to modulate temporally the synthesis parameters, and thereby to perform particularly powerful dynamic sound synthesis.

Another object of the present invention is the implementation of a process and a device for musical and vocal dynamic sound synthesis, in which every synthesized formant with specified central angular frequency has the same phase value with respect to the angular frequency of the fundamental sound, with which these formants are associated, this making it possible by superposition or addition of formants accordingly to modify the spectral envelope of the resulting synthesized sound with a very high quality of accuracy, precision and reproducibility thereof.

Another object of the present invention is finally the implementation of a process and a device for dynamic sound synthesis making it possible by straightforward multiplication of corresponding elementary devices for dynamic synthesis, to construct polyphonic synthesis systems operating in real time.

The process of musical and vocal dynamic sound synthesis of formants of specified amplitude, frequency and bandwidth, and which are associated with a fundamental sound, which is the subject of the present invention, is notable in that it consists in respect of at least one formant in producing a waveform which is the sum of several sound components satisfying the relation:

$$X(t)=\sum_{k=-\infty}^{\infty}[\mathrm{Cos}(k\omega_o+\omega_s)t+i\sin(k\omega_o+\omega_s)t]e^{-\frac{|k\omega_o+\omega_s-\omega_c|}{\delta}}$$

in which the angular frequency parameters $\omega_0$ denotes the angular frequency of the fundamental sound, $\omega_s$ an arbitrary value of formant angular frequency shift with respect to the fundamental sound or has [sic] any harmonic of this fundamental sound, k denoting a relative integer, $\omega_c$ the central angular frequency of this formant, $\delta$ denoting the bandwidth of this formant, each of the sound components produced having an amplitude $$A=e^{-\frac{|k\omega_o+\omega_s-\omega_c|}{\delta}}, \text{ and}$$

temporally modulating the said angular frequency parameters in order to carry out the said dynamic sound synthesis, the phase relations between formants thus being preserved.

The device for musical and vocal dynamic sound synthesis of formants of specified amplitude and bandwidth which are associated with a fundamental sound, which is the subject of the present invention, is notable in that it comprises at least one generator module of a waveform which is the sum of several sound components satisfying the relation:

$$X(t)=\sum_{k=-\infty}^{\infty}[\mathrm{Cos}(k\omega_o+\omega_s)t+i\sin(k\omega_o+\omega_s)t]\,e^{-\frac{|k\omega_o+\omega_s-\omega_c|}{\delta}}$$

in which the angular frequency parameters $\omega_0$ denotes the angular frequency of the fundamental sound, $\omega_s$ an arbitrary value of formant angular frequency shift with respect to the fundamental sound or a harmonic of this fundamental sound, $\omega_c$ denotes the central angular frequency of the formant, $\delta$ denotes the bandwidth of this formant, each of the sound components produced having an amplitude $$A=e^{-\frac{|k\omega_o+\omega_s-\omega_c|}{\delta}}.$$

A module for the temporal modulation of the angular frequency parameters is provided in order to carry out the dynamic synthesis, this making it possible to preserve the phase relations between formants thus produced.

Figure 5:
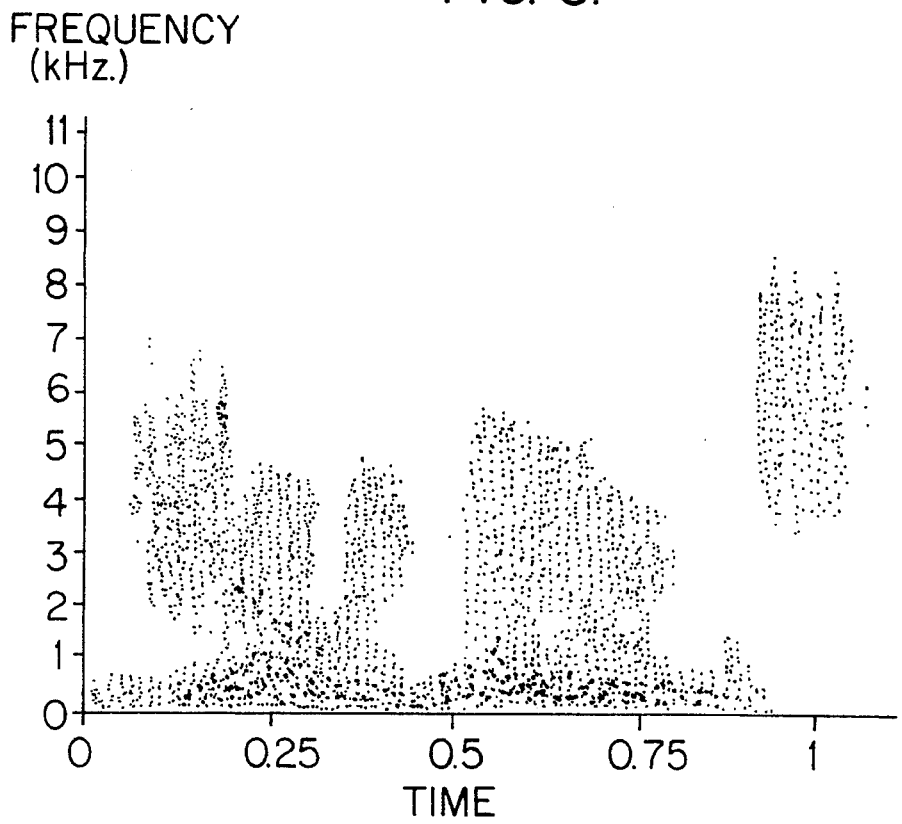
Figure 2A:
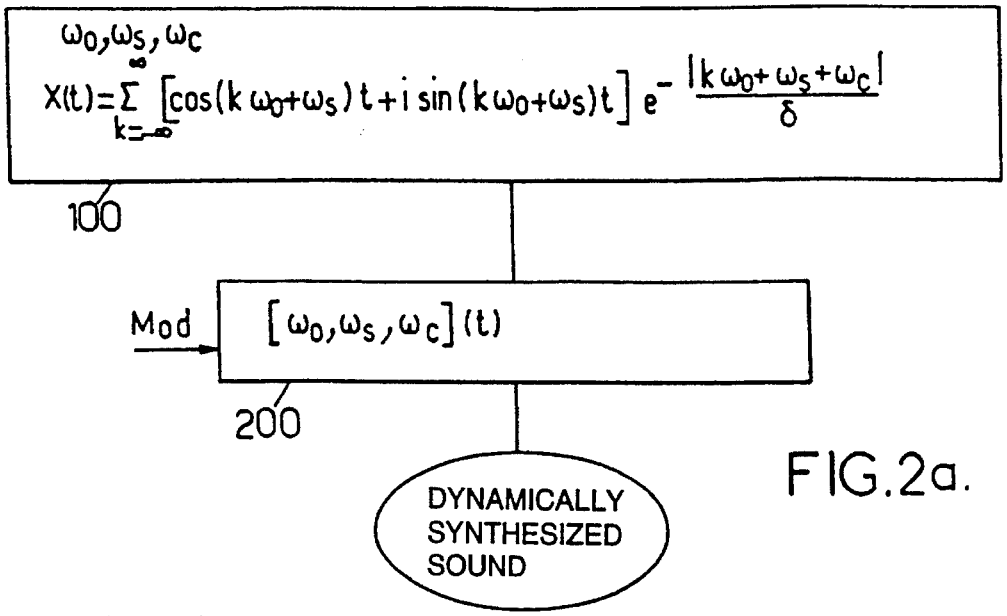
Figure 2B:
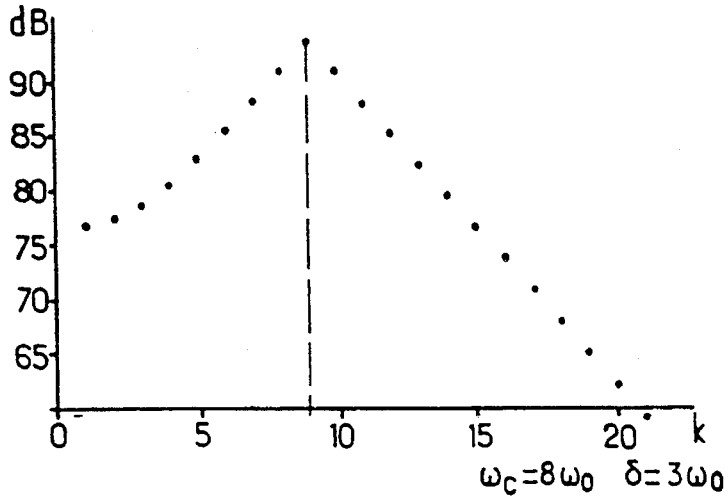
Figure 2C:
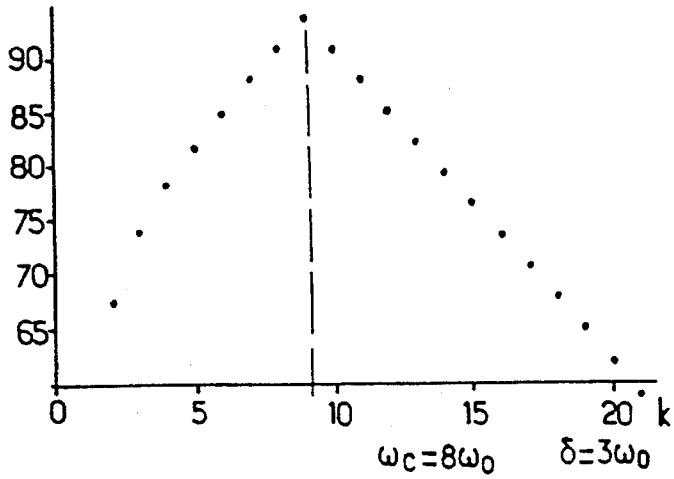
Figure 3:
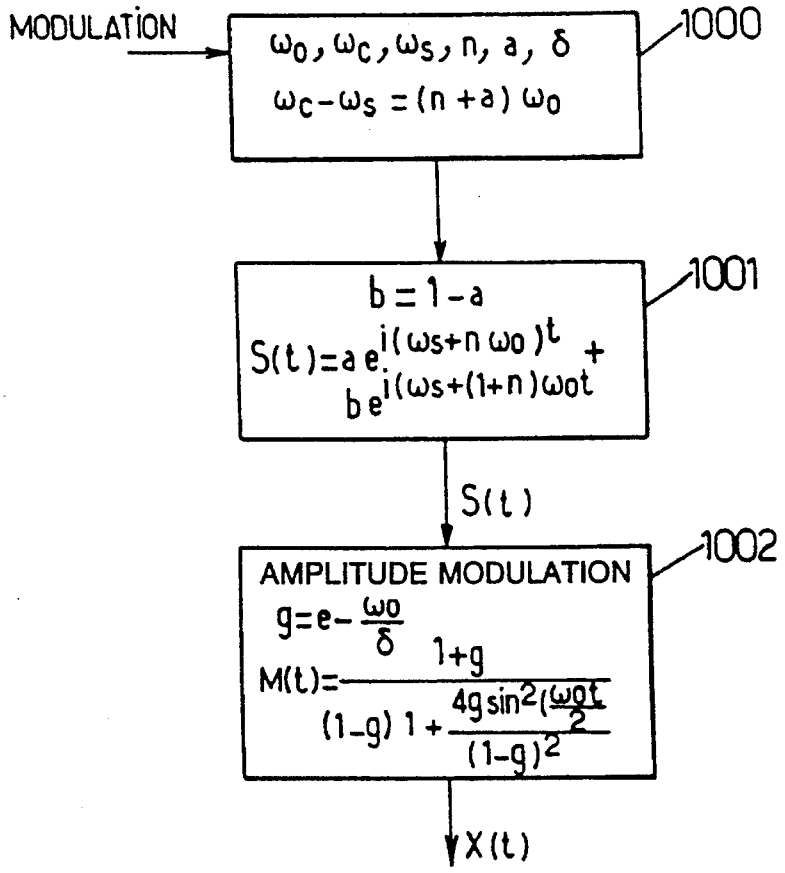
Figure 6:
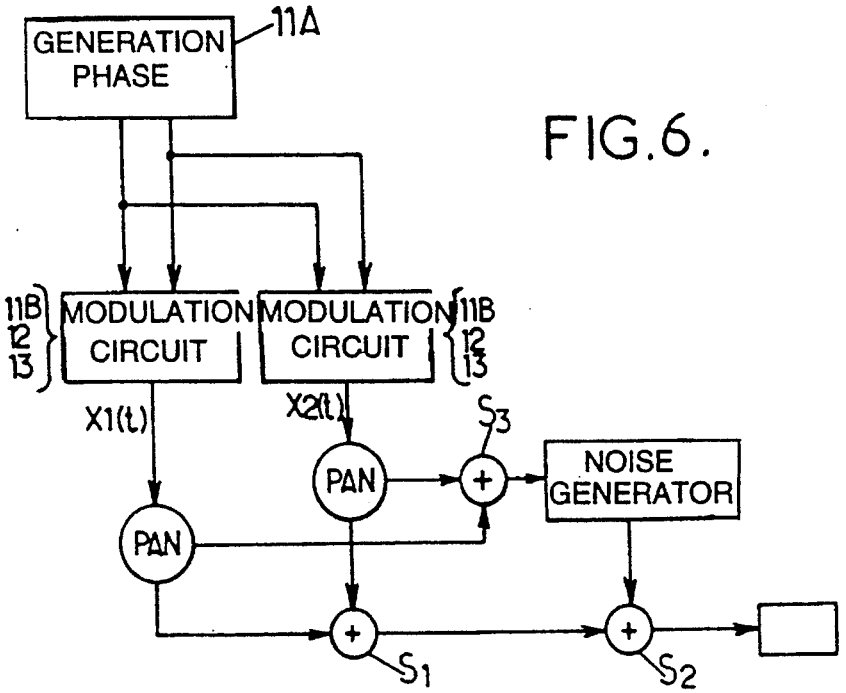
Figure 4:
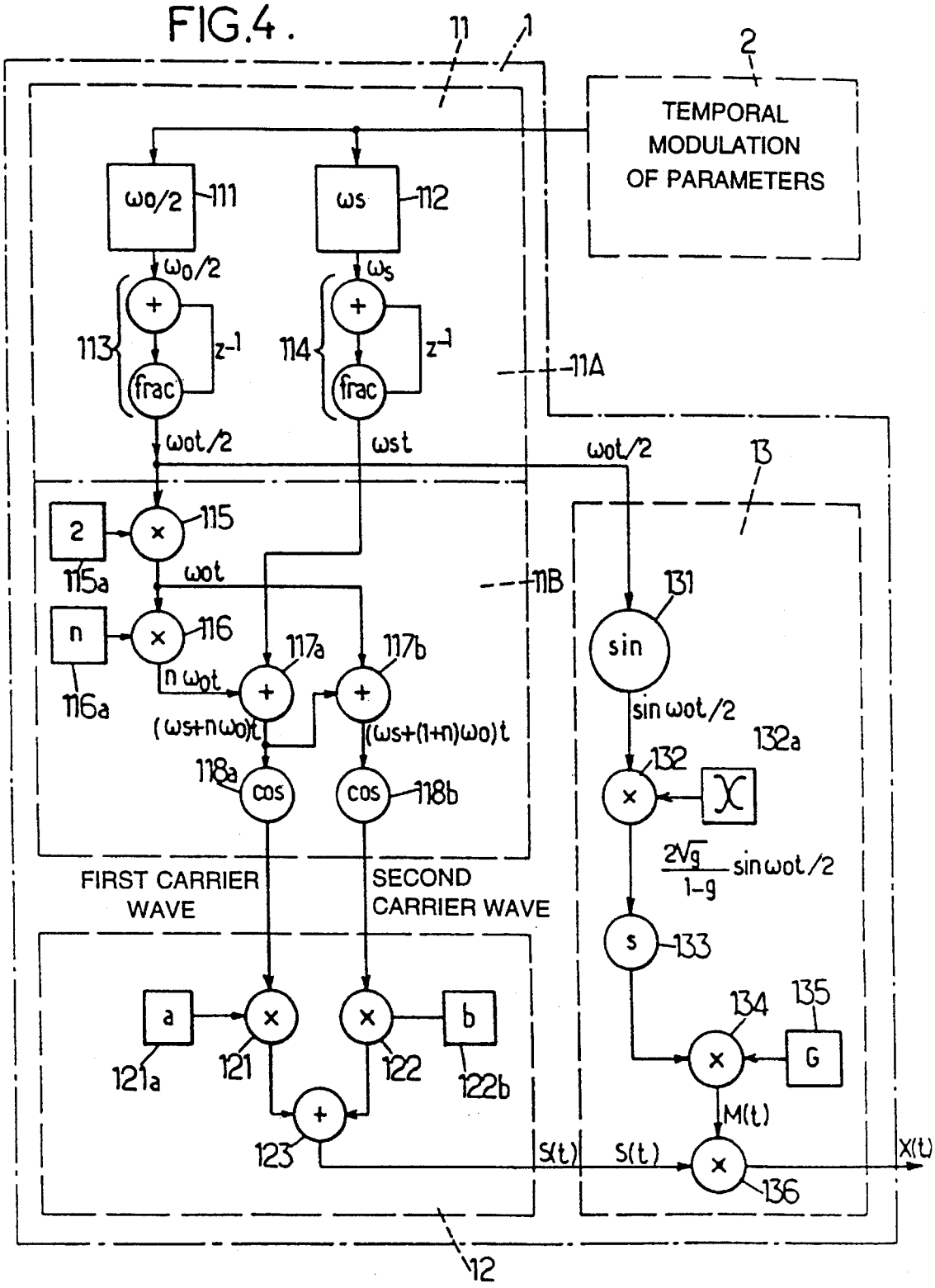

A more detailed description of the process and of the device for musical and vocal dynamic sound synthesis which is the subject of the present invention will be given in connection with the drawings below in which:

FIG. 1 represents a sonogram of the sound of a recorded word;

FIG. 2*a* represents a flow chart of the process of musical and vocal dynamic sound synthesis which is the subject of the present invention, FIGS. 2*b* and 2*c*, respectively, represent the spectrum of the real part and of the imaginary part of the waveform produced, representative of a formant, FIG. 3 represents, in the form of a flow chart, a preferred implementation of the process which is the subject of the present invention, FIG. 4 represents an illustrative diagram of a device for musical and vocal dynamic sound synthesis which is the subject of the present invention, FIG. 5 represents a sonogram of the sound of the same word as in FIG. 1 synthesized, by virtue of the implementation of the process and of the device which is the subject of the present invention, FIG. 6 represents the configuration of a device including a plurality of devices represented in FIG. 4 and allowing the production of a plurality of formants.

A more detailed description of the process and of the device for musical and vocal dynamic sound synthesis which is the subject of the present invention will now be given in connection with the aforesaid figures.

In FIG. 1 is represented a sonogram of the sound of a recorded word, the abscissa axis of the recording being graduated in seconds and the ordinate axis in frequency in KHz. It is recalled that the gray level of the various points of the recording represents the amplitude level of the constituent formants of the sound representative of the word recorded.

This recording serves as reference with a view to an assessment of the quality of dynamic sound synthesis of the process and of the device which is the subject of the present invention.

As is furthermore represented in the form of a flow chart in FIG. 2*a*, the process which is the subject of the present invention consists, with a view to producing at least one formant in order to perform the musical and vocal dynamic sound synthesis of formants of specified amplitude, frequency and bandwidth which are associated with a fundamental sound, in a step labelled 100, in generating a waveform which is the sum of several sound components satisfying the relation (1):

$$X(t)=\sum_{k=-\infty}^{\infty}[\mathrm{Cos}(k\omega_o+\omega_s)t+i\sin(k\omega_o+\omega_s)t]e^{-\frac{|k\omega_o+\omega_s-\omega_c|}{\delta}}$$

In this relation: the angular frequency parameters denote successively:

$\omega_0$ the angular frequency of the fundamental sound, $\omega_s$ an arbitrary value of formant angular frequency shift with respect to the fundamental sound or to any harmonic of this fundamental sound, k a relative integer, $\omega_c$ the central angular frequency of the relevant formant, $\delta$ the bandwidth of this formant.

According to a particular advantageous aspect of the process of the present invention, each component has an amplitude which is a non-linear function of the aforesaid angular frequency parameters, the amplitude term A of each sound component satisfying the relation (2):

$$A = e^{-\frac{|k\omega_0+\omega_s-\omega_c|}{\delta}}.$$

The aforesaid waveform having been generated in the abovementioned step 100, the process which is the subject of the present invention then consists in forming a temporal modulation in a step 200 of the aforesaid angular frequency parameters in order to carry out the previously mentioned dynamic sound synthesis.

The dynamically synthesized sound is obtained following the aforesaid operation 200, the phase relations between formants being thus preserved owing to the fact that in the aforesaid waveform, the angular frequency parameters are regarded as independent variables.

In view of the preservation of the phase relations between formants thus produced, the process according to the invention makes it possible to perform in a simple manner a superposition of one or more formants in accordance with a simple spectrum in order to produce much more complex spectra and, ultimately, a very great richness of sounds. Furthermore, the angular frequency parameters being temporally modifiable, they may be modified rapidly in such a way as to produce stable and predictable sound synthesis results.

Represented in FIG. 2*b* and 2*c* are the spectra of the real part and the imaginary part, respectively of a formant produced according to the waveform satisfying the relation (1) previously mentioned in the description, for a central angular frequency of formant $\omega_c=8.\omega_0$ and for $\delta=3.\omega_0$. In FIG. 2*b* the spectra of the real and imaginary parts are represented on a graph graduated along the abscissa according to the value of k, k denoting the rank of each constituent sound component of the formant, this graduation corresponding in fact to a graduation in relative frequency with respect to the frequency or angular frequency $\omega_0$ of the fundamental sound. The ordinate axis is graduated in decibels, the amplitude unit being represented by the value 100 dB.

In general, as is known from the conventional techniques for processing sound signals, it is pointed out that in practice it is simply necessary to evaluate either the real part or the imaginary part of the aforesaid waveform, by virtue of the constant phase relations between these two parts.

The aforesaid spectrum of the real and imaginary parts is obtained by adding or subtracting from the global spectrum properly speaking its reflection, that is to say values which are symmetric with respect to the zero frequency or angular frequency k=0.

In general, it is pointed out that the temporal modulation relating to the angular frequency parameters can also be applied to the bandwidth of each formant, it being possible to take this bandwidth $\delta$ for example proportional to the central frequency or central angular frequency of the fundamental sound.

Of course, in order to perform a real-time application of musical and vocal dynamic sound synthesis, that is to say with a view to performing applications in instrumental music, it is pointed out that the waveform previously mentioned in the description is produced in digital form by successive discrete values $X(r\tau)$ where $r\tau$ represents the instants of calculation of this waveform, r representing a relative integer and $\tau$ a calculation period similar to a sampling period, the waveform thus produced being delivered as a string of sampled values which can be processed and used by electronic musical instruments.

In order to optimize the numerical calculations, in terms of both volume of calculation and accuracy, a particularly advantageous mode of implementation of the process which is the subject of the present invention can be performed in the manner below, as represented in FIG. 3 in flow chart form.

According to the aforesaid figure, the process which is the subject of the present invention consists, in order to produce the abovementioned waveform X(t), in expressing in relative form with respect to the central angular frequency $\omega_0$ of the fundamental sound, the parameters of central angular frequency of the formant and of angular frequency shift $\omega_s$ of the formant with respect to this fundamental sound or to any harmonic of this fundamental sound. Thus, in step 1000 represented in FIG. 3, the angular frequency parameter $\omega_0$ of the fundamental sound having a specified value, subjected or not to temporal modulation, the angular frequency parameters $\omega_c$ and $\omega_s$ are expressed in relative form, relation (3):

$$\omega_c-\omega_s=(n+a)\omega_0.$$

In the aforesaid relation, it is pointed out that n denotes a positive integer and a denotes a real number, lying between 0 and 1, such that $0<a<1$.

The parameters having been fixed in the manner indicated in the aforesaid step 1000, the process which is the subject of the present invention then consists, in a step 1001, in producing a carrier wave S(t) which is the weighted sum of a first and of a second elementary carrier wave of respective angular frequency $\omega_s+n\,\omega_0$ and $\omega_s+(1+n)\omega_0$.

The weighted sum carrier wave satisfies the relation (4):

$$S(t)=ae^{i(\omega s+n\omega 0)t}+be^{i([\omega s+(1+n)\omega 0]t}$$

where b=1−a.

The aforesaid step 1001 is next followed by an amplitude modulation of the weighted sum carrier wave S(t) by an amplitude modulation coefficient, denoted M(t), which then satisfies the relation (5):

$$M(t)=\frac{(1+g)}{(1-g)\left[1+\frac{4g\sin^2\frac{(\omega_0 t)}{2}}{(1-g)^2}\right]}.$$

In the aforesaid relation, expressing the amplitude modulation coefficient M(t), g represents a measure of the bandwidth of the formant, this measure satisfying the relation (6):

$$g=e^{-\frac{\omega_0}{\delta}}.$$

The operating mode of the process which is the subject of the present invention such as illustrated in FIG. 3 can be justified in the manner below. In view of the expression for the angular frequency parameters in relative form which were previously indicated in connection with relation (3), the waveform representative of the formant such as represented by the previous relation (1) can be calculated for a frequency or angular frequency of the fundamental sound $\omega_0$ of specified value as the weighted sum of two particular values.

For the aforesaid values of n and a, the relation (1) can be rewritten in the form below, according to the relation (7):

$$X(t)=\sum_{k=-\infty}^{\infty} e^{i(\omega_s+k\omega_0)t-\frac{|\omega_0(-a+k-n)|}{\delta}}$$

Expressing relation (7) in the form of a weighted sum S satisfying the relation (8) below:

$$S=ve^{-|g(-1+k-n)|}+ue^{-|g(k-n)|}$$

makes it possible to write, in the case where b=1−a, as mentioned earlier, the relation (9) below:

$$S=[ue^{ag}+ve^{-(bg)}]e^{-|g(-a+k-n)|}.$$

For any value of sound component of rank k, a constituent of the formant, for k≧n, the expression for the weighted sum S can be written: relation (10)

$$S=[ue^{-(ag)}+ve^{bg}]e^{-|g(-a+k-n)|}.$$

For any relative integer value of k, we then obtain:

$$S=X=e^{-|g(-a+k-n)|}$$

provided that u and v satisfy the relation (11):

$$ue^{ag}+ve^{-(bg)}=ue^{-(ag)}+ve^{bg}=1.$$

For the value of $e^{\alpha}$ in the neighborhood of the origin, α around 0, approximated by the value 1+α, the solution of relation (11) is given by u=b, v=a.

In view of the aforesaid approximation, the expression according to relation (1) of the waveform can then be rewritten according to the relation (12):

$$X(t)=\frac{(1+g)[ae^{i(\omega_s+n\omega_0)t}+be^{i(\omega_s+(1+n)\omega_0)t}]}{(1-g)\left[1+\frac{4g\sin^2\frac{(\omega_0 t)}{2}}{(1-g)^2}\right]}$$

The above relation clearly shows that the waveform X(t) satisfies the relation: X(t)=S(t).M(t).

The above approximation in fact constitutes an improvement with respect to the exact result for small bandwidths since the expression for the energy of a formant, for k a relative integer, is substantially constant over time.

A more detailed description of a device for musical and vocal dynamic sound synthesis making it possible to implement the process which is the subject of the present invention will now be given in connection with FIG. 4.

Represented in the aforesaid FIG. 4 are the various modules making it possible to carry out the functions corresponding to the implementation of the steps of the process such as described earlier in the description.

Thus, the device according to the invention, such as represented in FIG. 4, comprises a module 1 which generates the waveform which is the sum of several sound components satisfying the relation (1) mentioned previously in the description.

Furthermore, the device according to the invention comprises a circuit 2 for temporal modulation of the angular frequency parameters, this modulation circuit 2 being able for example to consist of a hardware or software module making it possible to read-address tables of values of angular frequency parameters, the angular frequency $\omega_0$ of the fundamental sound, respectively $\omega_s$ of frequency shift of the formant with respect to this fundamental sound, as will be described below in the description.

The embodiment of the device which is the subject of the present invention such as represented in FIG. 4 corresponds to, and allows, the implementation of the process which is the subject of the present invention in the embodiment thereof such as represented in FIG. 3.

For this purpose, the waveform satisfying relation (1) is produced in digital form by successive discrete values at the instants of calculation of this waveform. The generator module of the aforesaid waveform 1 advantageously comprises a generator circuit 11 of a first and of a second carrier wave of angular frequency $(\omega_s+n\omega_0)$ respectively $\omega_s+(1+n)\omega_0$. This circuit 11 can comprise, as represented in FIG. 4, circuits 111, 112 for storing values of angular frequency $\omega_0/2$ respectively $\omega_s$, which are read by read-addressing by way of the circuit for temporal modulation of the parameters 2. These storage circuits 111, 112 deliver corresponding values $\omega_0/2$ respectively $\omega_s$.

Circuits 113 and 114 are provided, each formed by a summing circuit and a circuit for calculating a fractional part, denoted frac, which is looped back with a delay of one sampling period to the aforesaid summing circuit. The circuits 113 and 114 then deliver signals consisting of phase terms with values $\omega_0 t/2$ respectively $\omega_s t$. It is of course understood that these phase terms are delivered modulo $2\pi$, these phase terms being intended to constitute the arguments of the sine and cosine functions representing the corresponding waveforms.

The circuit 11 moreover comprises a multiplier circuit 115 receiving the first phase term $\omega_0 t/2$ and a term of value 2 delivered by a table of values **115*a* and delivering a signal $\omega_0 t$ and a multiplier circuit 116 receiving the aforesaid signal $\omega_0 t$ and a value n, itself delivered by a table of values 116*a*. The multiplier circuit 116** delivers a signal of value $n\omega_0 t$.

The generator circuit 11 of the first and of the second carrier wave of angular frequency $\omega_s+n\omega_0$ and $\omega_s+(1+n)\omega_0$ also comprises a first **117*a* and a second 117*b* adder circuit. The first adder circuit 117*a* receives the signal of value $n\omega_0 t$ and the second phase term $\omega_s t$ and in fact delivers a sum phase term, or first sum signal of value $\omega_s+n\omega_0 t$. The second adder circuit 117*b* receives the signal of value $\omega_0 t$ and the first sum signal delivered by the first summing circuit 117*a* in order to deliver a second sum signal in fact constituting a second sum phase term of the form $[\omega_s+(1+n)\omega_0]t$, The circuit 11 finally comprises a first 118*a* and a second 118*b* cosine operator. The first cosine operator 118*a* receives the first sum signal $(\omega_s+n\omega_0)t$ and delivers the first carrier wave of angular frequency $(\omega_s+n\omega_0)$ whereas the second cosine operator 118*b* receives the second sum signal delivered by the second summing circuit 117*b*** and delivers the second carrier wave of angular frequency $\omega_s+(1+n)\omega_0$.

Furthermore, the generator module 1 of the waveform which is the sum of several sound components satisfying relation (1) also includes a circuit 12 for weighted summation of the first and second carrier waves so as to produce the weighted carrier wave satisfying the relation (4) mentioned previously in the description.

The circuit 12 comprises a first 121 and a second 122 multiplier circuit receiving the first respectively the second carrier wave. A table of values **121*a* delivers the value a to the first multiplier circuit 121 and a table of values 122*b* delivers the value b to the multiplier circuit 122**. The first 121 and the second 122 multiplier circuit respectively delivers a first weighted carrier wave and a second weighted carrier wave to a summing circuit 123 which delivers the weighted carrier wave S(t) satisfying the relation (4) mentioned previously in the description.

The generator module 1 of the waveform satisfying the relation (1) mentioned previously finally includes as represented in FIG. 4, a circuit 13 making it possible to amplitude modulate the weighted carrier wave S(t) according to the temporal law expressed by relation (5) indicated previously in the description.

In the embodiment represented in FIG. 4, it is indicated that the amplitude modulation circuit 13 includes for example a sine operator 131 receiving the first phase term of the form $\omega_0 t/2$, this operator circuit 131 delivering a signal of the form sine $\omega_0 t/2$. In the modulator circuit 13 a multiplier 132 is also provided, which receives on the one hand the aforesaid signal delivered by the sine operator 131 and, on the other hand, a value X delivered by a table of values 132*a*, this value X being expressed in the form $$\frac{2\sqrt{g}}{1-g},$$

the multiplier circuit 132 delivering a first product signal $$\frac{2\sqrt{g}}{1-g}\cdot\sin\omega_0 t/2.$$

A transfer function operator $1/1+\beta^2$, with $\beta$ the value of the aforesaid product signal is provided, this function operator circuit, denoted s, receiving this first product signal and delivering a corresponding transformed signal satisfying the relation:

$$\frac{1}{1+\frac{4g\sin^2\frac{(\omega_0 t)}{2}}{(1-g)^2}}$$

A second multiplier circuit 134 is provided which receives the transformed signal delivered by the transfer function operator s, as well as a ratio value $$G=\frac{1+g}{1-g},$$

this ratio value being delivered by a table of values 135.

The second multiplier 134 delivers the amplitude modulation signal M(t) to a third multiplier circuit 136, which receiving the weighted carrier wave S(t) delivered by the weighted summation circuit 12, delivers as output the waveform X(t) representative of the relevant formant.

As regards the use of the transfer function s, it is pointed out that the latter is justified bearing in mind the fact that the propagation of calculation errors is a minimum when applying the transfer function s by reason of the fact that the maximum value of the ratio $s'(\beta)/s(\beta)$ where $s'(\beta)$ denotes the derivative of s with respect to $\beta$ is equal to 1. For further details on the implementation of the aforesaid transfer function it is pointed out that the latter can be constructed on the basis of a lookup table. Worthwhile reference may be made to the publication by M. LEBRUN, 1979, entitled "*Digital Waveshaping Synthesis*", Journal of the Audio Engineering Society, 27/4, pp. 250–266.

FIG. 5 shows a sonogram of the sound of the same word synthesized, in accordance with the implementation of the process which is the subject of the present invention by virtue of the use of a device such as represented in FIG. 4.

In general, it is pointed out that the quality of synthesis is significant since comparison of the two figures obviously shows that the time distribution in amplitude and frequency of the formants thus constituted is substantially similar. The resynthesized waveform represented in FIG. 5 has been obtained by virtue of the use of six synthesis devices, such as represented in FIG. 4, each of them producing a specific formant. The formants themselves have been introduced by parametrization of the aforesaid angular frequency values, using the system developed by the author of the present invention, M. PUCKETTE, and described in 1990 in the article "*EXPLODE: A User Interface for Sequencing and Score Following*" Proceedings, International Computer Music Conference, pp. 259–261. It is noted, as regards the differences in spectral distribution between the synthesized word represented in FIG. 5 and that represented in FIG. 1, that these differences are due in part to the fact that the formants were altered in such a way as to render the sonority of the word uttered more natural.

In order to effect the association of a plurality of devices such as represented in FIG. 4, it is advantageous, as represented in FIG. 6, to provide a single generator module of phase terms, which bears the reference 11A in FIG. 4, and a plurality of modulation circuits similar to the circuit 11B represented in FIG. 4, with which are associated of course the circuit 12 and the circuit 13 for amplitude modulation. Each of the modulation circuits then makes it possible to deliver a formant X1(t), X2(t), which can be recombined by virtue in particular of the summing circuits S1, S2, S3 represented in FIG. 6, by reason of the fact of the preservation of the phase of each formant with respect to the angular frequency $\omega_0$ of the fundamental signal. A noise generator can be appended with a view to special effects.

As regards the temporal modulation of the angular frequency parameters, it is pointed out moreover that the parameters n, a, b and lastly x the modulation index, can be modulated over time. However, these latter cannot be modified discontinuously without bringing about clicks or audible noises at output. The value of G can be modulated linearly but the values of n, a and b necessitate, in order to be modified, a few precautions. The value n being an integer, it cannot be modified continuously. When scanning of the central angular frequency of the formant $\omega_c$ and of the angular frequency of the fundamental sound $\omega_0$ is performed continuously, the values a and b can be modulated rapidly, however, with the risk of introducing a displeasing effect on the synthesized sound.

To avoid this kind of drawback, the aforesaid angular frequencies $\omega_0$ and $\omega_c$ can be modified discontinuously when the phase terms modulo $2\pi$ go through 0. It is recalled in fact that in relation (12) mentioned previously in the description, the expression for the waveform X(t) is independent of n, a and b when the phase term is zero. In view of the fact that the parameter x depends on the angular frequency of the fundamental sound $\omega_0$, for a specified value of $\delta$, the value of x the modulation index should advantageously be modified or updated in synchronism with the modifications of the angular frequency of the fundamental sound $\omega_0$, that is to say when the phase terms modulo $2\pi$ go to zero.

It is furthermore pointed out that the procedure for discontinuous modification of the angular frequency parameters in order to perform the dynamic synthesis according to the subject of the process of the present invention, has a major advantage: any synthesis device which includes, for example, two modulation circuits, such as represented in FIG. 6, which share the same phase term generator, can be exchanged at any moment since the phase relations are identical. Thus, the group of formants to be synthesized can always be maintained in ascending order of amplitude or of central frequency $\omega_c$, this naturally simplifying in consequence the problem of synthesizing transitions from one formant to another.

Finally, it is pointed out that the synthesis device which is the subject of the present invention such as represented in FIGS. 4 or 6, can advantageously be used to construct multichannel polyphonic synthesis machines, this polyphonic synthesis device being able for example to include means of temporal multiplexing of the channels so as to construct, from one or more devices, such as represented in FIG. 6 for example, a complete polyphonic system.

I claim:

1. A process for musical and vocal dynamic sound synthesis of formants of specified amplitude, frequency and bandwidth, said formants being associated with a fundamental sound, and said process comprising, with respect to at least one formant:

producing a waveform which is the sum of several sound components satisfying the relation:

$$X(t)=\sum_{k=-\infty}^{\infty}[\mathrm{Cos}(k\omega_o+\omega_s)t+i\sin(k\omega_o+\omega_s)t]e^{-\frac{|k\omega_o+\omega_s-\omega_c|}{\delta}}$$

wherein $\omega_o$, $\omega_s$, $\omega_c$ and $\delta$ are angular frequency parameters and $\omega_o$ denotes the angular frequency of the fundamental sound, $\omega_s$ denotes an arbitrary value of formant angular frequency shift with respect to the fundamental sound or to any harmonic of this fundamental sound, k denoting a relative integer, $\omega_c$ denotes the central angular frequency of this formant, and $\delta$ denotes the bandwidth of this formant, each of the generated sound components having an amplitude $$A=e^{-\frac{|k\omega_o+\omega_s-\omega_c|}{\delta}};\text{ and}$$

temporally modulating said angular frequency parameters in order to carry out the dynamic sound synthesis, the phase relationships between formants thus being preserved.

2. A process according to claim 1, wherein said waveform is produced in digital form by successive discrete values $X(r\tau)$ where $r\tau$ represents the instants of calculation of said waveform, r representing a relative integer and $\tau$ a calculation period similar to a sampling period.

3. A process according to claim 1, wherein in order to produce said waveform X(t), the values of said angular frequency parameters being expressed in relative from with respect to the angular frequency $\omega_o$ of the fundamental sound, with $\omega_c-\omega_s=(n+a)\ \omega_o$ where n denotes a positive integer and a denotes a real number such that $0<a<1$, said process comprising:

generating a carrier wave s(t) which is the weighted sum of first and second elementary carrier waves of angular frequency $(\omega_s+n\omega_o)$ and $[\omega_s+(1+n)\ \omega_o]$, respectively, said weighted sum carrier wave satisfying the relation:

$$S(t)-ae^{i(\omega s+n\omega O)t}+be^{i[\omega s+(1+n)\omega O]t},\text{ where } b=1-a,$$

temporally amplitude-modulating said weighted sum carrier wave by an amplitude modulation coefficient M(t) satisfying the relation:

$$M(t)=\frac{(1+g)}{(1-g)\left[1+\frac{4g\sin^2\frac{(\omega_0 t)}{2}}{(1-g)^2}\right]}$$

wherein g represents a measure of bandwidth of the formant satisfying the relation:

$$g=e^{-\frac{\omega_0}{\delta}}.$$

4. A device for musical and vocal dynamic sound synthesis by non-linear distortion and amplitude modulation of at least one formant of specific amplitude, frequency and bandwidth, said formant being associated with a fundamental sound, and said device comprising:

generator means for generating a waveform which is the sum of several sound components satisfying the relation:

$$X(t)=\sum_{k=-\infty}^{\infty}[\mathrm{Cos}(k\omega_o+\omega_s)t+i\sin(k\omega_o+\omega_s)t]e^{-\frac{|k\omega_o+\omega_s-\omega_c|}{\delta}}$$

in which $\omega_o$, $\omega_s$, $\omega_c$ and $\delta$ are angular frequency parameters and $\omega_0$ denotes the angular frequency parameter of the fundamental sound, $\omega_s$ denotes an arbitrary value of formant angular frequency shift with respect to the fundamental sound or a harmonic of this fundamental sound, $\omega_c$ denotes the central angular frequency of the formant, $\delta$ denotes the bandwidth of this formant, each of the sound components produced having an amplitude $$A=e^{-\frac{|k\omega_o+\omega_s-\omega_c|}{\delta}};\text{ and}$$

means for providing temporal modulation of said angular frequency parameters in order to carry out said dynamic synthesis, thereby allowing the phase relationships thus produced between formants to be preserved.

5. The device according to claim 4, wherein said waveform is produced in digital form by successive discrete values $X(r\tau)$ where $r\tau$ represents the instants of calculation of said waveform, r denoting a relative integer and $\tau$ denoting a calculation period similar to a sampling period, said generator means comprising:

a generator for generating first and second carrier waves of angular frequency $(\omega_s+n\omega_o)$ and $[\omega_s+(1+n)\ \omega_o]$, respectively, where n denotes a positive integer, means for producing a weighted summation of said first and second carrier wave in order to produce a weighted carrier wave satisfying the relation $$S(t)=ae^{i(\omega s+n\omega O)t}+be^{i[\omega s+(1+n)\omega O]t}$$

where a denotes a real number such that $0<a<1$ and $b=1-a$, amplitude modulator means for providing amplitude modulation of said weighted carrier wave according to a temporal law satisfying the relation $$M(t)=\frac{(1+g)}{(1-g)\left[1+\frac{4g\sin^2\frac{(\omega_0 t)}{2}}{(1-g)^2}\right]}$$

wherein g represents a measure of the bandwidth of the formant satisfying the relation:

$$g=e^{-\frac{\omega_0}{\delta}}.$$

6. A device according to claim 5, wherein said generator for generating said first and second carrier waves comprises:

first and second generators for generating phase terms and for producing first and second phase terms proportional to $\omega_o$ for the form $\omega_o t/2$, and $\omega^s t$ modulo $2\pi$ respectively;

multiplier circuits for producing, on the basis of said first phase term, a signal $\omega_o t$ and a signal $n\omega_o t$;

first and second adder circuits, said first adder circuit receiving said second phase term $\omega_s t$ and said signal $n\omega_o t$ and producing a first sum signal $o(\omega_s+n\omega_o)t$, and said second adder circuit receiving said signal $\omega_o t$ and said first sum signal $(\omega_s+n\omega_o)t$ and delivering a second sum signal $[\omega_s+(1+n)\omega_o]t$; and first and second cosine operators receiving said first and second sum signals, respectively, and producing said first and second carrier waves, respectively.

7. A device according to claim 6, wherein said means for producing said weighted summation of the first and second carrier waves comprises:

first and second lookup tables of numerical values a, b;

first and second multiplier circuits, said first multiplier circuit receiving said first carrier wave and said numerical value a and producing a first weighted carrier wave, said second multiplier circuit receiving said second carrier wave and said numerical value b and producing a second weighted carrier wave; and a summing circuit receiving said first and said second weighted carrier wave and producing said weighted carrier wave.

8. A device according to claim 7, wherein said amplitude modulator means includes:

a sine operator receiving said first phase term of the form $\omega_o t/2$ and delivering a signal $\sin \omega_o t/2$;

a first multiplier circuit receiving said phase term of the form $\omega_o t/2$ and a value $$\frac{2\sqrt{g}}{1-g}$$

$\sin \omega_o t/2$; $\omega_o t/2$, for receiving said first product signal and for producing a transformed signal;

a second multiplier circuit for receiving said transformed signal and a ratio value $$G=\frac{1+g}{1-g}$$

and for producing a second product signal, constitutive of said amplitude modulation signal M(t); and a third multiplier circuit for receiving said weighted carrier wave S(t) and said amplitude modulation signal and for producing said waveform X(t)=M(t).S(t).

* * * * *